US010662754B2

(12) United States Patent
Logan et al.

(10) Patent No.: US 10,662,754 B2
(45) Date of Patent: May 26, 2020

(54) DIRECTIONAL DRILLING APPARATUS AND METHODS

(71) Applicant: EVOLUTION ENGINEERING INC., Calgary (CA)

(72) Inventors: Aaron W. Logan, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 965 days.

(21) Appl. No.: 14/903,111

(22) PCT Filed: Jul. 4, 2014

(86) PCT No.: PCT/CA2014/050639
§ 371 (c)(1),
(2) Date: Jan. 6, 2016

(87) PCT Pub. No.: WO2015/003266
PCT Pub. Date: Jan. 15, 2015

(65) Prior Publication Data

US 2016/0138381 A1 May 19, 2016

Related U.S. Application Data

(60) Provisional application No. 61/843,356, filed on Jul. 6, 2013.

(51) Int. Cl.

| | |
|---|---|
| ***E21B 17/20*** | (2006.01) |
| ***E21B 47/024*** | (2006.01) |
| ***E21B 47/12*** | (2012.01) |
| ***E21B 44/00*** | (2006.01) |
| ***E21B 7/06*** | (2006.01) |
| ***E21B 4/00*** | (2006.01) |

(52) U.S. Cl.
CPC ..... *E21B 44/005* (2013.01); *E21B 4/006* (2013.01); *E21B 7/067* (2013.01); *E21B 17/20* (2013.01); *E21B 47/024* (2013.01); *E21B 47/12* (2013.01)

(58) Field of Classification Search
None
See application file for complete search history.

(56) References Cited

U.S. PATENT DOCUMENTS

| | | | |
|---|---|---|---|
| 5,316,090 | A | 5/1994 | Kuwana et al. |
| 5,617,926 | A | 4/1997 | Eddison et al. |
| 5,738,178 | A | 4/1998 | Williams et al. |
| 5,875,859 | A | 3/1999 | Ikeda et al. |

(Continued)

FOREIGN PATENT DOCUMENTS

| | | | |
|---|---|---|---|
| CA | 2395082 | A1 | 6/2001 |
| CA | 2647032 | A1 | 10/2007 |

(Continued)

*Primary Examiner* — Matthew R Buck
*Assistant Examiner* — Douglas S Wood
(74) *Attorney, Agent, or Firm* — Oyen Wiggs Green & Mutala LLP

(57) ABSTRACT

Apparatus for directional drilling allows an uphole section of drill string to be rotated while maintaining a desired orientation of a bent section of the drill string. In some embodiments, clutches above and below the bent section are selectively operated to rotate the bent section to a desired orientation. Reducing transmissions may reduce the rotation rate of the bent section.

59 Claims, 7 Drawing Sheets

(56) References Cited

U.S. PATENT DOCUMENTS

| | | | | |
|---|---|---|---|---|
| 6,059,661 | A | 5/2000 | Simpson | |
| 6,092,610 | A | 7/2000 | Kosmala et al. | |
| 6,129,160 | A | 10/2000 | Williams et al. | |
| 6,948,572 | B2 * | 9/2005 | Hay | E21B 7/062 175/61 |
| 7,270,198 | B2 | 9/2007 | Camp | |
| 7,510,031 | B2 | 3/2009 | Russell et al. | |
| 7,549,467 | B2 | 6/2009 | McDonald et al. | |
| 7,987,927 | B2 | 8/2011 | Downton | |
| 8,322,461 | B2 | 12/2012 | Hay et al. | |
| 8,528,662 | B2 * | 9/2013 | Camp | E21B 47/024 175/45 |
| 2007/0209839 | A1 | 9/2007 | Arnoldy | |
| 2011/0284292 | A1 | 11/2011 | Gibb et al. | |

FOREIGN PATENT DOCUMENTS

| | | | |
|---|---|---|---|
| CA | 2642713 | A1 | 5/2010 |
| GB | 2456421 | A | 7/2009 |
| GB | 2501461 | A | 10/2013 |
| JP | H05-149079 | A | 6/1993 |
| WO | 2011102820 | A1 | 8/2011 |

* cited by examiner

DIRECTIONAL DRILLING APPARATUS AND METHODS

CROSS-REFERENCE TO RELATED APPLICATION

This application claims priority from U.S. Application No. 61/843,356 filed 6 Jul. 2013. For purposes of the United States, this application claims the benefit under 35 U.S.C. § 119 of U.S. Application No. 61/843,356 filed 6 Jul. 2013 and entitled DIRECTIONAL DRILLING APPARATUS AND METHODS which is hereby incorporated herein by reference for all purposes.

TECHNICAL FIELD

This application relates to subsurface drilling, specifically to directional drilling. Embodiments are applicable to but not limited to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

In some circumstances it is desirable to cause a drill bore to follow a trajectory that may include changes in direction. For example, it may be desirable to drill straight down to a desired depth and then cause the drill bore to turn so that the drill bore extends horizontally in a desired direction. Various directional drilling technologies have been developed to allow a rotary drill to be steered so as to cause a wellbore to follow a desired path. Rotary steerable technologies fall into two broad categories which can be described as "push-the-bit" and "point-the-bit". Push-the-bit systems steer a drill bit by applying a side load that forces the bit laterally in a desired direction. The most common push-the-bit tools use pads on the outside of the tool which press against the well bore thereby causing the bit to drill more toward the opposite side causing a direction change. Point-the-bit systems steer the bit by tilting the bit in the direction of the desired curve. Point-the-bit systems generally include a bent section in the drillstring near the bit and a mud motor to drive the bit so that drilling can proceed without rotating the entire drill string. The bend points the bit in a direction different from the axis of the wellbore. By pumping mud through the mud motor, the bit turns while the drillstring does not rotate, allowing the bit to drill in the direction it points. When a desired wellbore direction is achieved, that direction may be maintained by rotating the entire drillstring (including the bent section) so that the bit does not drill in a single direction off the wellbore axis, but instead sweeps around and its net direction coincides with the existing wellbore.

RSS (Rotary steerable system) is another directional drilling technology. RSS tools allow steering while the drill string is rotating. Some RSS tools provide pads that can rotate relative to the drill string and are operable to steer the bit.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Electronics in a BHA may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A BHA may include various sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc.

Downhole sensors may detect the direction and angle of inclination of the drill string near the drill bit. Data from such sensors may be used in directional drilling applications to help guide the borehole to follow a desired trajectory.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

One or more systems may be provided for telemetry of data to the surface. Data telemetry techniques include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Some patent references in the general field of the invention include: U.S. Pat. Nos. 5,738,178; 5,617,926; 6,092,610; 6,129,160; 7,549,467; 7,987,927; 8,322,461; GB2456421; CA2395082; CA2642713; and CA2647032.

There remains a need for alternative methods for directional drilling.

SUMMARY

This invention has a number of aspects. These include methods for directional drilling and various apparatus for directional drilling. One aspect provides an apparatus for directional drilling. The apparatus comprises a bent section, a clutch connected at an uphole end of the bent section and an orientation sensor mounted to monitor an orientation of the bent section. A controller is configured to compare the monitored orientation of the bent section to a desired orientation and to control the clutch to apply a correction to the orientation of the bent section. In some embodiments the uphole end of the bent section is coupled to an output shaft of a first reducing transmission and the clutch is connected in series with the reducing transmission.

In some embodiments the output shaft of the first reducing transmission is coupled to the uphole end of the bent section and the clutch is connected to an input shaft of the transmission. The first reducing transmission may have a through hole in fluid communication with a bore of the bent section. The first reducing transmission may, for example, comprise a harmonic drive™ (i.e. a strain wave gear drive).

Some embodiments have an anti-rotation apparatus attached to a body of the first reducing transmission. In an example embodiment the anti-rotation apparatus comprises an actuator configured to press one or more pads radially outwardly against a borehole wall.

Some embodiments include a second reducing transmission having an output shaft coupled to a downhole end of the bent section. The second reducing transmission may, for example, comprise a harmonic drive™ (i.e. a strain wave gear drive). A second clutch may be connected in series with the second reducing transmission. A controller may be connected to control the first and second clutches to maintain a desired average orientation of the bent section. The controller may, for example, be configured to alternate between a first period of engaging the first clutch while disengaging the second clutch and a second period of engaging the second clutch while disengaging the first clutch. The controller may be configured to correct an average orientation of the bent section by altering the duration of one or both of the first and second periods in one or more cycles.

In some embodiments the controller is configured to adjust a range of oscillation of the bent section in response to a measurement of a diameter of the borehole. For example, the range of oscillation of the bent section may be increased in response to a determination that a diameter of the borehole is decreased. The range of oscillation may be controlled automatically or in response to signals from a human operator or supervisory system that may, for example, be located at the surface.

In some embodiments the apparatus includes an actuator configured to press one or more pads radially outwardly to engage a wall of the borehole and the controller is configured to adjust the range of oscillation of the bent section in response to a configuration of the one or more pads when pressed against the wall of the borehole.

Another aspect provides apparatus for directional drilling. The apparatus comprises: a bent section; a first clutch connected at an uphole end of the bent section; a first reducing transmission; an orientation sensor mounted to monitor an orientation of the bent section; and a controller configured to compare the monitored orientation of the bent section and to control the first clutch to apply a correction to the orientation of the bent section. The uphole end of the bent section is coupled to an output shaft of the first reducing transmission and the first clutch is connected in series with the first reducing transmission.

Another aspect provides apparatus for directional drilling. The apparatus comprises a section of the drill string to be oriented, for example a bent section having uphole and downhole ends. The uphole end of the bent section is coupled by a first clutch to a section of drill string uphole from the bent section. The downhole end of the bent section coupled by way of a second clutch to a drill bit downhole from the bent section. The apparatus includes an orientation sensor mounted to monitor an orientation of the bent section and a controller configured to compare the monitored orientation of the bent section to a desired orientation and to control the first and second clutches to maintain the orientation of the bent section within a desired range of the desired orientation. In some embodiments the controller is configured to alternate between a first period of engaging the first clutch while disengaging the second clutch and a second period of engaging the second clutch while disengaging the first clutch. In some embodiments the controller is configured to set a default length for the first period by engaging the first clutch while disengaging the second clutch and monitoring a rate of rotation of the bent section. In some embodiments the controller is configured to correct an average orientation of the bent section by altering the duration of one or both of the first and second periods in one or more cycles. In addition to maintaining an average orientation of the section, a range of angular oscillation of the section may be varied to compensate for wear of the drill bit and/or adjust diameter of the borehole.

Other aspects of the invention provide methods for directional drilling as described herein. One such aspect provides a method for controlling an orientation of a section in a drill string that comprises while rotating an uphole portion of the drill string uphole from the section: performing a first step of engaging a first clutch to couple the section to be rotated by the uphole portion of the drill string, thereby causing orientation of the section to change in a first direction; and performing a second step of disengaging the first clutch to allow the section to rotate relative to the uphole portion of the drill string while engaging a second clutch to more tightly couple the section to a rotating drill bit, thereby causing the orientation of the section to change in a second direction opposed to the first direction. In some embodiments the first and second steps are repeated in alternation.

Another example aspect provides a method for controlling the orientation of a bent section or other component of a directional drilling string. The method comprises detecting a current orientation of the bent section; comparing the current orientation to a desired orientation; engaging a first clutch coupled between the bent section and a rotating section of the drill string uphole from the bent section and disengaging a second clutch coupled between the bent section and a rotating section of the drill string downhole from the bent section if the orientation of the bent section is more than a first threshold amount away from the desired orientation in a first direction; and engaging the second clutch and disengaging the first clutch if the orientation of the bent section is more than a second threshold amount away from the desired orientation in a second direction opposite to the first direction.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
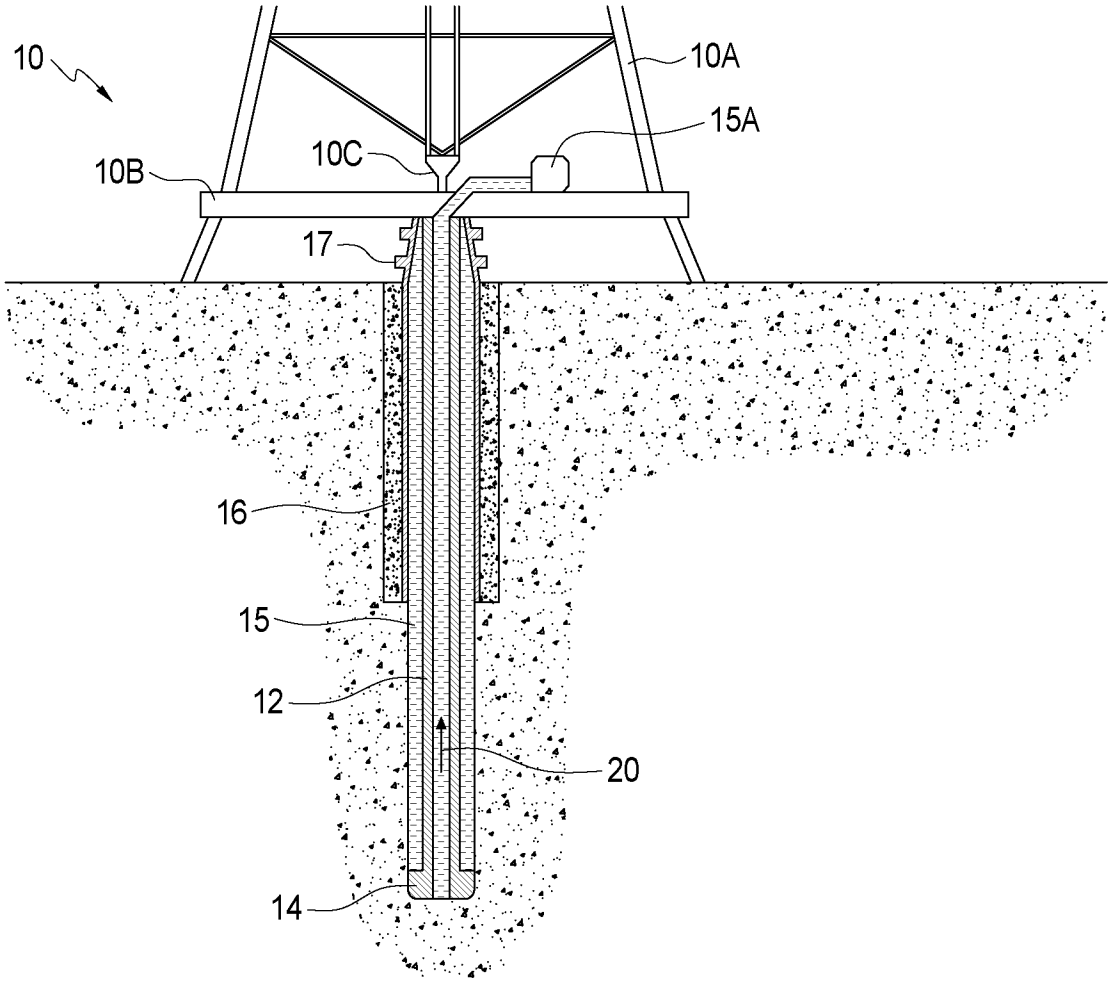
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Figure 2:
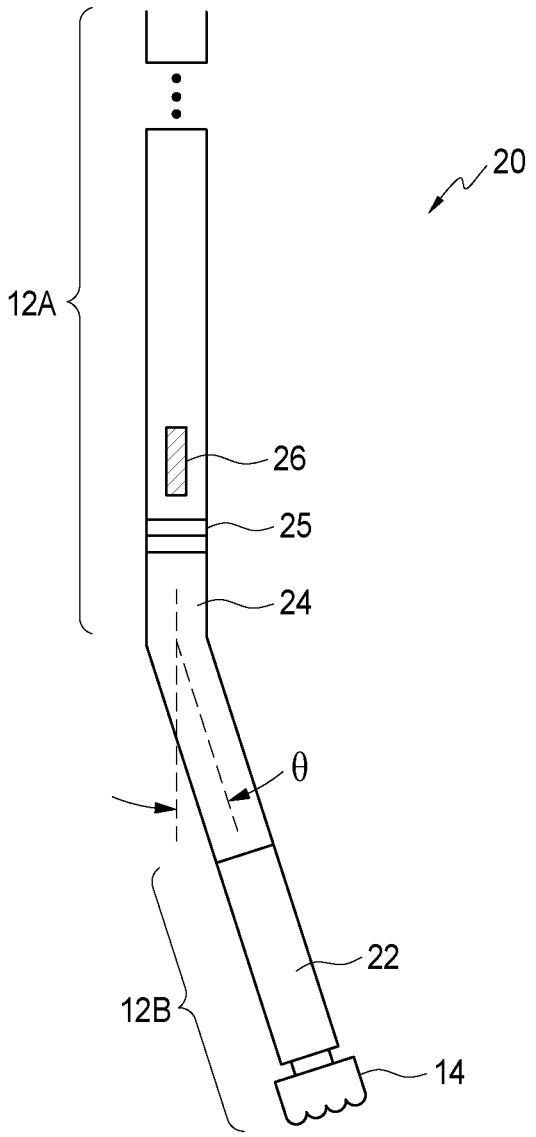
FIG. 2 is a schematic illustration showing drilling apparatus according to some example embodiments.

FIG. 2 shows drilling apparatus 20 according to an example embodiment. Apparatus 20 comprises a drill string 12 and a drill bit 14. Drill bit 14 is connected to a mud motor 22 that can be operated to rotate drill bit 14 (whether or not drill string 12 is being rotated). Located in the drill string, preferably near to drill bit 14 is a bent section 24. Bent section 24 may, for example, comprise a bent sub having suitable uphole and downhole couplings mounted at angles to one another. As seen in FIG. 2, a longitudinal centerline of a section of drill string uphole from bent section 24 forms an angle θ with a longitudinal centerline of the apparatus downhole from bent section 24.

Bent section 24 is located downhole from a rotary coupling 25 such that bent section 24 can turn relative to an uphole part 12A of drill string 12 about rotary coupling 25. Apparatus 20 comprises a control mechanism 26 that controls rotation of the sides of rotary coupling 25 relative to one another.

By operating control mechanism 26 to control rotation at rotary coupling 25, bent section 24 may be maintained in a desired orientation (to provide a desired curve of the borehole being drilled) while upper part 12A of drill string 12 is rotated. Rotating uphole section 12A of drillstring 12 while drilling can be advantageous because rotating the drillstring can reduce friction between the drillstring and the well bore. Friction between the drillstring and the wellbore can reduce the force applied to the drill bit. This, in turn, can reduce penetration rate. Turning upper part 12A while drilling can reduce friction and, therefore, increase penetration rate. Another benefit of rotating uphole section 12A of drillstring 12 is that rotation of the drill string can help keep drill cuttings suspended in the drilling fluid so they can be lifted to the surface more effectively.

Control mechanism 26 does not need to drive rotation of rotary coupling 25. In some embodiments uphole section 12A and downhole section 12B of drillstring 12 are driven to rotate in opposite directions. Control mechanism 26 may comprise a clutch that varies the torque transmitted across rotary coupling 25.

Consider the following example. Uphole section 12A is driven to rotate clockwise (as viewed looking down from the surface) by a drill rig. Mud motor 22 is operated to drive drill bit 14 to rotate clockwise. The reaction torque from driving bit 14 is transmitted to downhole section 12B and tends to make downhole section 12B (together with bent section 24 which is part of downhole section 12B in this example) rotate counterclockwise. The material of the drillstring is elastic and acts as a torsional spring. The reaction torque from drilling is able to 'wrap' or twist the drillstring.

Figure 2A:
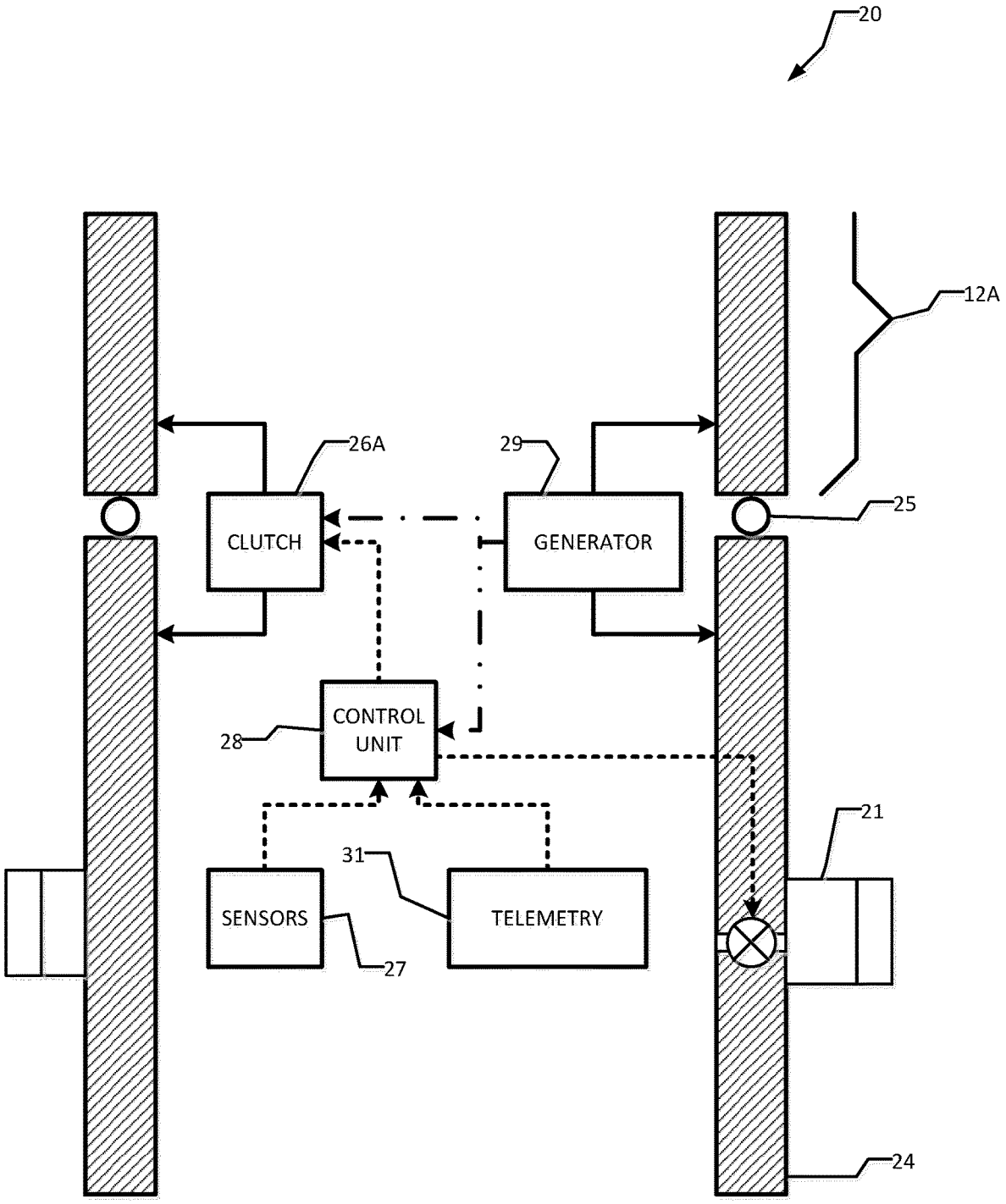
FIG. 2A is a schematic detail showing an angle control mechanism.

As shown in FIG. 2A, control mechanism 26 includes a clutch 26A that can be controlled to vary the torque transmitted across rotary coupling 25. If clutch 26A is disengaged (no torque transfer), uphole section 12A will rotate clockwise and downhole section 12B will rotate counterclockwise as a result of the reaction force from drilling rotary coupling 25 will freely swivel. If clutch 26A is fully engaged without slipping then uphole section 12A will rotate clockwise and downhole section 12B, being locked to uphole section 12A, will also rotate clockwise.

Clutch 26A may be set in between being fully engaged and fully disengaged so that clutch 26A transmits just enough torque to counteract the reaction force from drilling that would otherwise drive rotation of lower section 12B. With this setting of clutch 26A, the orientation of bent section 24 remains fixed.

The orientation of bent section 24 may be altered by momentarily increasing or decreasing the torque transmitted through clutch 26A relative to the 'balance point' at which bent section 24 is not being rotated. By slightly increasing the torque transmitted by clutch 26A, bent section 24 may be made to rotate slowly clockwise. By slightly decreasing the torque transmitted by clutch 26A, bent section 24 may be made to rotate slowly counterclockwise.

Control mechanism 26 may include an orientation sensor for determining the orientation of bent section 24. The orientation sensor may, for example, comprise one or more sensors such as an inclinometer, a magnetic field sensor (e.g. a compass), a gyroscope (e.g. a laser gyro) or the like. Sensors are indicated generally by 27. An output of the sensors is provided to an electronic control unit 28. Control unit 28 determines from the sensor output(s) a change in the orientation of bent section 24 and/or a deviation in the orientation of bent section 24 from a desired orientation. In response to the signals, control unit 28 controls actuation of clutch 26A to maintain the desired orientation of bent section 24.

Control unit 28 may comprise, for example, one or more data processors such as microprocessors, embedded processors, digital signal processors or the like configured to receive data (including information about the orientation of bent section 24) and/or commands and to control the operation of control mechanism 26 based on those inputs. Where control unit 28 includes a data processor, control unit 28 may also comprise software that configures the data processor to operate control mechanism 26 as described herein. In addition or in the alternative, control unit 28 may comprise custom digital and/or analog circuits configured to perform functions that collectively operate control mechanism 26.

Control unit 28 may comprise or be connected to receive data from a telemetry system 31 configured for receiving downlink telemetry commands. Such commands may, for example, be provided from a control station at the surface. The commands may, for example, command changes in the orientation of bent section 24.

Control unit 28 may operate, for example, by frequently determining from the readings of sensors 27 whether the orientation of bent section 24 should be changed and, if so, in what direction. In response, control unit 28 may change the signal actuating clutch 26A to alter the orientation of bent section 24. For example, control unit 28 may actuate clutch 26A to briefly increase the torque transmitted by clutch 26A in order to shift the orientation of bent section 24 clockwise or to briefly decrease the torque transmitted by clutch 26A in order to shift the orientation of bent sub 24 counterclockwise.

Control unit 28 may also act to control the actuation of clutch 26A to find the 'balance point' at which there is no change in the orientation of bent section 24. For example, control unit 28 may monitor to determine a direction of drift (clockwise or counterclockwise) of the orientation of bent section 24. In response to detecting a clockwise drift, control unit 28 may incrementally reduce the torque transmitted by clutch 26A. In response to detecting a counterclockwise drift, control unit 28 may incrementally increase the torque transmitted by clutch 26A.

Apparatus 20 may optionally include a mechanism 21 for holding the orientation of bent section 24. Holding mechanism 21 may, for example, comprise one or more hydraulically actuated pads coupled to bent section 24. The pads may be extended outwardly to engage a wall of the wellbore. Control unit 28 may operate the holding mechanism 21 to inhibit rotation of bent section 24 when bent section 24 is oriented at the desired orientation.

The relative rotation of the different sides of rotary coupling 25 may be used to generate electrical power. FIG. 2A shows an electrical generator 29 connected across rotary coupling 25. Electricity produced by electrical generator 29 may be applied to drive control unit 28 and clutch 26A, charge batteries for powering downhole systems or the like.

Apparatus 20 has the advantage of conceptual simplicity. However, the design of apparatus 20 requires clutch 26A to be slipping all or most of the time. This can place significant demands on the design of clutch 26A and the control system provided by control unit 28. In some embodiments, clutch 26A consists of or comprises a variable torque converter. In some such embodiments provision is made to lock the torque converter to allow transfer of torque from uphole drillstring section 12A to bent section 24 without slippage.

Figure 3:
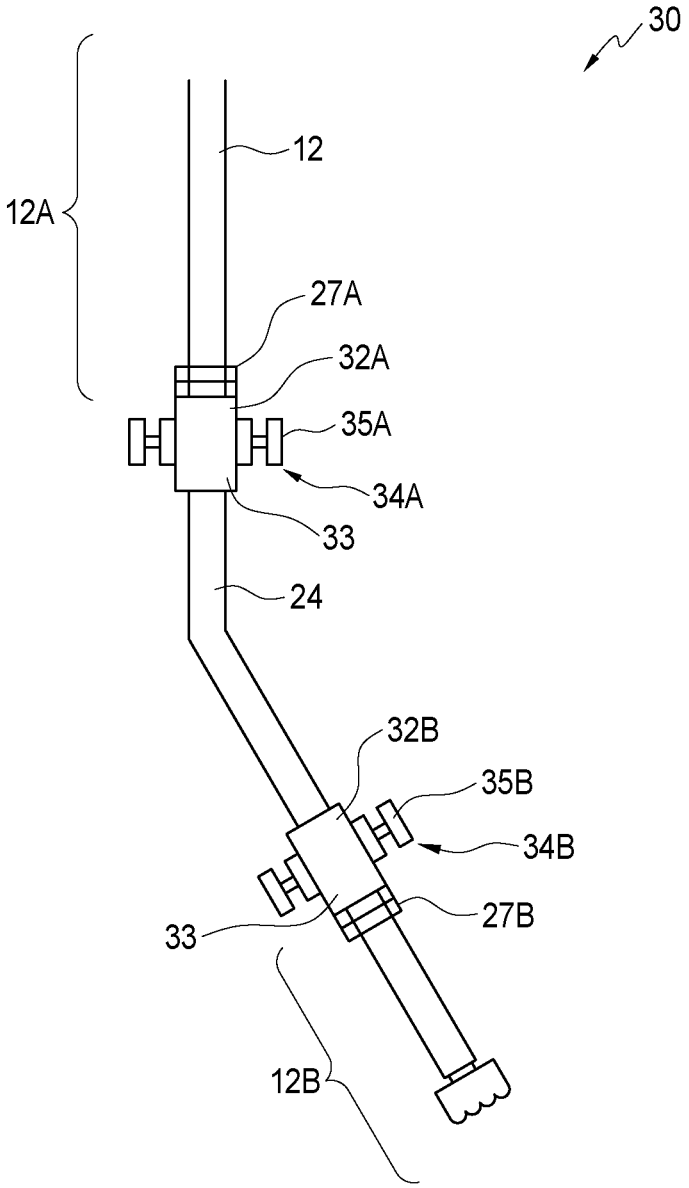
FIG. 3 is a schematic illustration showing apparatus according to some embodiments.
Figure 3A:
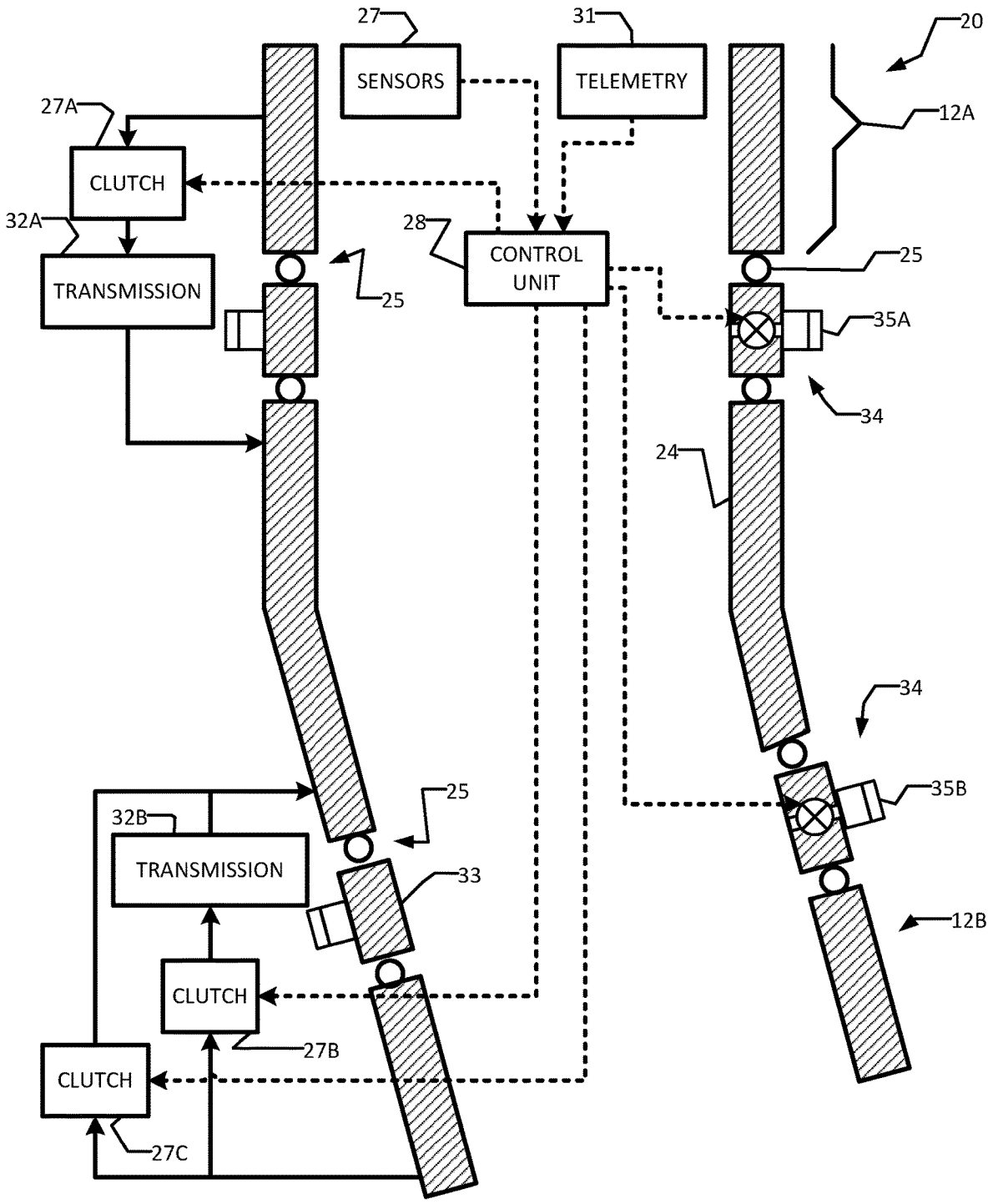
FIG. 3A is a schematic illustration showing apparatus like that of FIG. 3 with components of a control mechanism shown schematically.

FIG. 3 shows apparatus 30 according to an alternative embodiment. FIG. 3A illustrates schematically a possible control mechanism for apparatus 30. Apparatus 30 may be operated according to a principle similar to apparatus 20. Apparatus 30 comprises speed reducing transmissions 32A and 32B (collectively or generally transmissions 32) located on uphole and downhole sides of bent section 24 respectively. Each transmission 32 may, for example, comprise a suitable planetary transmission, harmonic drive, geared transmission or the like. A controllable clutch is provided in series with each transmission 32. In the illustrated embodiment, clutch 27A is provided in series with transmission 32A and clutch 27B is provided in series with transmission 32B. In some embodiments, a variable torque converter is connected in series with one or both of clutches 27A and 27B. In some embodiments, one or both of clutches 27A and 27B comprises a torque converter which may transmit torque at a level controlled by a controller.

Transmissions 32 are configured to provide through passages for drilling fluid. Such passages may extend, for example through the transmission output shaft that may extend all of the way through the transmission 32.

Transmission 32A has an input shaft coupled to uphole section 12A of drill string 12 and an output shaft coupled to bent section 24. Transmission 32B has an input shaft coupled to downhole section 12B of drill string 12 and an output shaft coupled to bent section 24.

Each of transmissions 32 comprises a transmission body 33 and a mechanism 34 to hold transmission body 33 against rotation. In the illustrated embodiment, each transmission 32 is associated with one or more hydraulically-operated pads that can be urged outwardly to engage walls of the wellbore. Radially outward ends of the pads are equipped with shoes 35A and 35B (generally and collectively shoes 35). Shoes 35 are shaped to resist rotation in the wellbore but to slide along the wellbore as drilling progresses. Mechanism 34A carrying shoes 35A is provided for transmission 32A. Mechanism 34B carrying shoes 35B is provided for transmission 32B.

Transmission 32A is a step-down transmission such that a speed of rotation at the input shaft coupled to uphole section 12A is faster than a speed of rotation at an output coupled to bent section 24.

Transmission 32A may have a gear ratio sufficient to slow the rotation of its output relative to a typical rotation rate of uphole section 12A to a speed of a few revolutions per minute (RPM) or less. For example, if uphole section 12A is normally driven at a speed of 50 RPM then transmission 32A could, for example, have a ratio of 50:1 such that its output which is connected to bent section 24 rotates at a speed of about 1 RPM. In some embodiments the gear ratio of transmission 32A is in the range of 20:1 to 200:1.

Transmission 32B is also a step down transmission. Transmission 32B may have a gear ratio sufficient to slow the rotation of its output relative to a typical rotation rate of downhole section 12B also to a speed of a few RPM or less. For example, if downhole section 12B can be driven at a speed of up to 300 RPM by reaction forces from operating drill 14 then transmission 32B could, for example, have a ratio of 300:1 such that its output rotates at a speed of about 1 RPM when its input (coupled to downhole section 12B) is driven at 300 RPM. In some embodiments, transmission 32B has a higher ratio than transmission 32A. In some embodiments, transmission 32B has a ratio in the range of 50:1 to 400:1.

It is not necessary that transmissions 32 have ratios such that the rotational speeds of the outputs of transmissions 32A and 32B be matched since downhole section 12B is not positively locked to the formation into which drill 14 is drilling.

In this example embodiment, when clutches 27A and 27B are both engaged, uphole section 12A may be turned clockwise from the surface at, for example, 50 RPM, downhole section 12B may be turned counterclockwise by the reaction to the torque applied to turn drill bit 14 at, for example, 200 RPM and bent section 24 may rotate, for example, at 1 RPM in either direction (the direction of rotation of bent section 24 depends on the construction of transmissions 32).

Bent section 24 may be maintained at a desired orientation by controlling clutches 27A and 27B. In some embodiments another clutch or brake 27C is provided. Clutch or brake 27C can be actuated to fix the orientation of bent section 24 relative to downhole portion 12B.

Various modes of operation are possible. Apparatus according to different embodiments may be configured to enable one or more such modes of operation. In some embodiments the apparatus comprises a control unit like control unit 28 described above and the configuration is provided by suitable software instructions and/or configured analog and/or digital circuits that cause the control unit to operate apparatus 30 as described herein. In one example mode of operation, when bent section 24 is oriented in the desired direction (to within a suitable tolerance) clutch 27A may be disengaged such that it serves as a rotary coupling (or more generally allows uphole drillstring section 12A to rotate relatively freely relative to bent section 24). In this configuration, little or no torque is transferred from uphole section 12A of drill string 12 to bent section 24. In this configuration, pressure on pads 35A may be relaxed somewhat. At the same time, clutch 27B may be disengaged and a separate clutch 27C (see FIG. 3A) may be engaged to fix the relative orientation of downhole section 12B and bent section 24 such that torque is delivered to drill bit 14. Pads 35B may be engaged to hold the orientation of bent section 24.

If the orientation of bent section 24 shifts from the desired orientation (and/or if the desired orientation of bent section 24 is changed) then clutches 27A, 27B and the separate clutch 27C may be operated to change the orientation of bent section 24. For example, clutch 27A may be engaged for a time sufficient to rotate bent section 24 clockwise by a desired amount (note that any desired orientation of bent section 24 may be achieved by rotating bent section 24 far enough clockwise). It is also possible to rotate bent section 24 counterclockwise to a desired orientation by disengaging clutch 27C, engaging clutch 27B, and reducing the pressure on pads 35B.

Another mode of operation requires only two clutches. In this alternative mode of operation a separate clutch is not required. One of clutches 27A and 27B may be engaged while the other one of clutches 27A and 27B is disengaged. Pressure on the pads 35 corresponding to the disengaged clutch may be reduced. In this mode of operation, bent section 24 may always be rotating in one direction or another. However, because of transmissions 32, bent section 24 rotates only relatively slowly. The direction of rotation of bent section 24 can be reversed by changing which one of clutches 27A and 27B is engaged. Therefore, the orientation of bent section 24 may be made to oscillate about a desired orientation by engaging clutches 27A and 27B in alternation. This mode of operation may be advantageous for reducing friction between drillstring 12 and the walls of the borehole since it permits upper section 12A of drillstring 12 to be rotating during sliding (e.g. during drilling operations in which the orientation of bent section 24 is kept more or less fixed).

The accuracy with which the orientation of bent section 24 is controlled can depend on how often the direction of rotation of bent section 24 is reversed. For example, if bent section 24 is rotating at 1 RPM alternating between clockwise and counterclockwise rotation then shifting the direction of rotation approximately once every ½ second will result in bent section 24 swinging through an angle of only ±1½ degrees from a desired orientation.

The orientation of bent section 24 may be adjusted by slightly altering the length of time that bent section 24 is allowed to rotate in one direction before the direction of rotation is reversed. For example, the orientation of bent section 24 may be moved clockwise by increasing the length of time that clutch 27A is engaged relative to the length of time that clutch 27B is engaged. Where bent section 24 rotates at a speed of 1 RPM, for each ⅙ second that the length of time during which clutch 27A is engaged in a cycle exceeds or is less than the length of time that clutch 27B is engaged in the cycle the orientation of bent section 24 is shifted by 1 degree. Thus, over the course of one or more cycles the orientation of bent section 24 may be shifted by any desired amount in either direction.

In some embodiments a degree of oscillation of bent section 24 may be controlled to alter the diameter of the borehole being drilled. Increasing the range of oscillation tends to make the borehole larger while decreasing the range of oscillation tends to make the borehole smaller. In some embodiments, control over the degree of oscillation (e.g. controlling how often the direction of rotation of bent section 24 is reversed) may be used to compensate for wear of drill bit 14. As drill bit 14 wears, the diameter of the borehole being drilled may be reduced. The range of oscillation of bent section 24 may be increased to compensate at least partially for such wear. In some embodiments the range of oscillation is set according to a parameter value that can be set in response to commands sent from the surface by a suitable telemetry method.

The diameter of the borehole being drilled may be measured in various ways. For example, positions of the borehole wall may be detected using contact or non-contact sensors. In an example embodiment pads 35A and/or 35B are used to directly measure the diameter of the borehole. In response to pads 35A and/or 35B being compressed inwardly (signifying a reduced borehole diameter) the timing of reversal of motion of bent section 24 may be altered (e.g. by increasing the time between reversals) to provide a wider range of oscillation.

In another example embodiment only clutch 27A is required. Clutch 27A may be engaged and pads 35A engaged to cause bent section 24 to rotate clockwise relatively slowly (compared to the rate of rotation of uphole section 12A). Clutch 27A may be periodically disengaged and the pressure on pads 35A relaxed to allow the reaction torques resulting from the rotation of drill 14 to rotate bent section 24 counterclockwise. By alternating between engaging and disengaging clutch 27A, bent section 24 may be made to maintain a desired average orientation.

Figure 4:
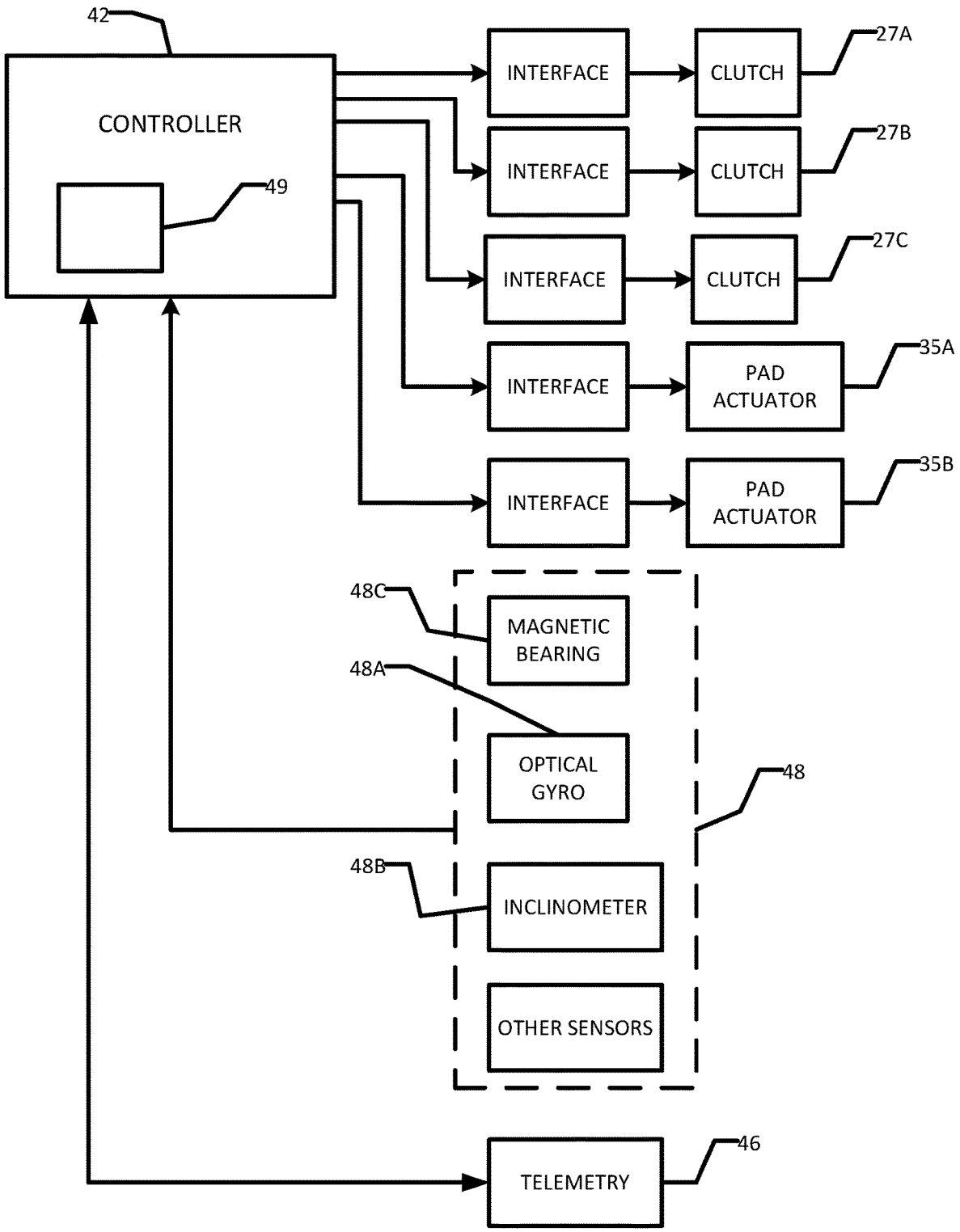
FIG. 4 is a block diagram showing a control system according to some embodiments.

FIG. 4 shows schematically an example control system 40 for the apparatus of FIG. 3. Control system 40 may, for example, be located between transmissions 32 in drill string 12. Control system 40 may, for example, be packaged in a housing located within a bore of drillstring 12 and/or within a wall of drillstring 12.

Control system 40 comprises a controller 42. Controller 42 may comprise one or more programmable processors configured by software instructions stored in a memory to perform as described herein, logic circuits, configurable logic elements (e.g. field-programmable gate arrays), combinations thereof, custom analog and/or digital circuits or the like. Control system 40 is connected to control clutches 27A and 27B and to control pressure on pads 35A and 35B by suitable interfaces.

Control system 40 comprises one or more orientation sensors 48 that monitor orientation of bent section 24. In the illustrated embodiment, sensors 48 comprise an optical gyro 48A, an inclinometer 48B, and a magnetic bearing sensor 48C. Other embodiments may have fewer or more sensors or sensors of other types.

Control system 40 also comprises a telemetry system 46. Telemetry system 46 is configured to at least receive telemetry signals. The telemetry signals may include commands to set the orientation of bent section 24 to a particular orientation and/or to change the orientation of bent section 24 in a commanded direction by a commanded amount. Control system 40 includes a register or other memory location 49 which stores the current desired orientation of bent section 24.

Figure 5:
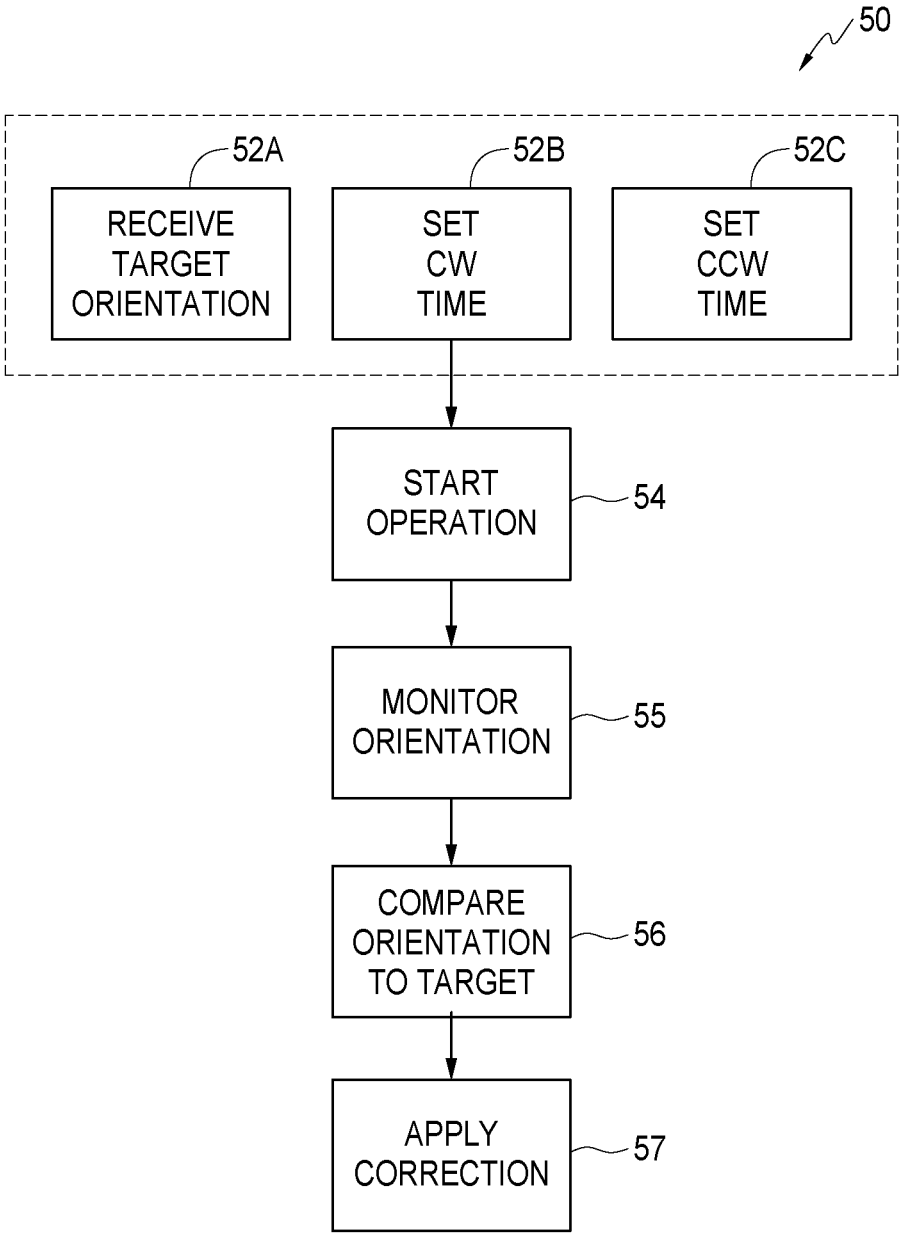
FIG. 5 is a flow chart showing a method according to some embodiments.

FIG. 5 is a flow chart illustrating a method 50 that may be performed by controller 40. In block 52A, method 50 receives and stores in register 49 a target orientation for bent section 24. In block 52B method 50 sets a first default length of time for clockwise rotations. In block 52C method 50 sets a second default length of time for counterclockwise rotations.

In some embodiments, block 52B includes engaging clutch 27A, disengaging clutch 27B, measuring a rotation rate of bent section 24 and setting the desired length of time for clockwise rotations based on the measured rotation rate. In some embodiments, block 52C includes engaging clutch 27B, disengaging clutch 27A, operating mud motor 22, measuring a rotation rate of bent section 24 and setting the desired length of time for counterclockwise rotations based on the measured rotation rate. In some embodiments the default first and second lengths of time determined in blocks 52B and 52C are coordinated such that no net shift in the orientation of bent section 24 results from cyclically rotating bent section 24 clockwise (by engaging clutch 27A and disengaging clutch 27B) for the first default length of time and rotating bent section counterclockwise (by engaging clutch 27B and disengaging clutch 27A) for the second default length of time.

In block 54 controller 40 commences an operating mode in which bent section 24 is controlled to rotate clockwise and rotate counterclockwise in alternating periods. Block 55 monitors the orientation of bent section 24 as indicated by sensor(s) 48 and determines an average orientation of bent section 24. Block 56 compares the average orientation determined by block 55 to the target orientation obtained in block 52A. If these are different then block 56 determines a correction to the angle of bent section 24. Block 57 applies the correction determined in block 56 by temporarily applying adjustments to the lengths of one or both of the clockwise rotation and the counterclockwise rotation periods. In some embodiments the amount(s) by which the clockwise rotation period and the counterclockwise rotation period are adjusted depends on the magnitude of the correction determined by block 56. In other embodiments one or both of the clockwise rotation period and the counterclockwise rotation period are adjusted by predetermined amount(s) to achieve a clockwise drift or a counterclockwise drift in the orientation of bent section 24.

In some embodiments, the gear ratio provided by second transmission 32B is selected such that second transmission 32B drives bent section 24 to counter-rotate at a speed faster than first transmission 32A drives bent section 24 to rotate. In such embodiments, the counterclockwise rotation period may be significantly shorter than the clockwise rotation period. This may enhance drilling efficiency.

In the discussion above it has been assumed that when upper section 12A of drill string is rotated, the rotation is clockwise when viewed from above. While this is conventional, the present technology is not limited to any particular direction of rotation. A system as described herein could operate equally with counterclockwise rotation of upper section 12A and clockwise rotation of lower section 12B.

The technology described herein with reference to FIG. 3 can be used where bent section 12A can be rotated one way by driving its rotation from upper section 12A and rotated the opposite way by driving its rotation from lower section 12B.

Various embodiments described herein use clutches The clutches in any of these embodiments may be of a range of types including dry clutches, wet clutches, multi-plate clutches, clutches having flat plates, clutches having cylindrical plates (e.g. clutches constructed with members that move radially inwardly or outwardly to engage a drum or cylinder or the like, torque converters combinations of these and so on). In some embodiments as described above, the clutches may be either applied or not applied and do not necessarily slip when applied. In other embodiments one or more clutches may be of a type that can transmit a controllable torque.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

INTERPRETATION OF TERMS

Unless the context clearly requires otherwise, throughout the description and the

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.
- the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back," "top," "bottom," "below," "above," "under," "clockwise," "counterclockwise" and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. Apparatus for directional drilling, the apparatus comprising:

a bent section;

a section of drill string extending from the surface uphole from the bent section;

a first reducing transmission having an input arranged to be driven by rotation of the section of drill string and an output shaft coupled to rotate an uphole end of the bent section by way of a first clutch connected in series with the first reducing transmission, the first reducing transmission configured to rotate the output shaft at a speed of rotation that is slower than a speed of rotation of the input;

an orientation sensor mounted to monitor a rotational orientation of the bent section;

a controller configured to compare the monitored orientation of the bent section to a desired orientation of the bent section and to control the first clutch to apply a correction to the orientation of the bent section; and a first anti-rotation apparatus attached to a body of the first reducing transmission.

2. Apparatus according to claim 1 wherein the first clutch is connected to the input of the first reducing transmission.

3. Apparatus according to claim 1 wherein the first reducing transmission comprises a through hole in fluid communication with a bore of the bent section.

4. Apparatus according to claim 1 wherein the first reducing transmission comprises a strain wave gear drive.

5. Apparatus according to claim 1 wherein the first reducing transmission has a ratio in the range of 20:1 to 200:1.

6. Apparatus according to claim 1 wherein the first clutch comprises a variable torque converter.

7. Apparatus according to claim 1 wherein the controller comprises a field-programmable gate array.

8. Apparatus according to claim 1 wherein the first anti-rotation apparatus comprises a first actuator configured to press one or more pads radially outwardly.

9. Apparatus according to claim 1 wherein the controller comprises a telemetry receiver configured to receive telemetry signals comprising commands specifying the desired orientation for the bent section.

10. Apparatus for directional drilling, the apparatus comprising:

a bent section;

a section of drill string extending from the surface uphole from the bent section;

a first reducing transmission having an input arranged to be driven by rotation of the section of drill string and an output shaft coupled to rotate an uphole end of the bent section by way of a first clutch connected in series with the first reducing transmission, the first reducing transmission configured to rotate the output shaft at a speed of rotation that is slower than a speed of rotation of the input;

an orientation sensor mounted to monitor a rotational orientation of the bent section;

a controller configured to compare the monitored orientation of the bent section to a desired orientation of the bent section and to control the first clutch to apply a correction to the orientation of the bent section; and a second reducing transmission having an output shaft coupled to a downhole end of the bent section.

11. Apparatus according to claim 10 wherein the second reducing transmission comprises a through hole in fluid communication with a bore of the bent section.

12. Apparatus according to claim 10 wherein the second reducing transmission comprises a strain wave gear drive.

13. Apparatus according to claim 10 wherein the second reducing transmission has a ratio in the range of 50:1 to 400:1.

14. Apparatus according to claim 10 comprising a second anti-rotation apparatus attached to a body of the second reducing transmission.

15. Apparatus according to claim 14 wherein the second anti-rotation apparatus comprises a second actuator configured to press one or more pads radially outwardly.

16. Apparatus according to claim 10 comprising a second clutch connected in series with the second reducing transmission.

17. Apparatus according to claim 16 wherein the second clutch comprises a variable torque converter.

18. Apparatus according to claim 16 wherein the second clutch is connected to an input shaft of the second reducing transmission.

19. Apparatus according to claim 16 wherein the controller is connected to control the first and second clutches, the controller configured to alternate between a first period of engaging the first clutch while disengaging the second clutch and a second period of engaging the second clutch while disengaging the first clutch.

20. Apparatus according to claim 19 wherein the controller is configured to correct an average orientation of the bent section by altering the duration of one or both of the first and second periods in one or more cycles.

21. Apparatus according to claim 19 wherein the controller is configured to adjust a range of oscillation of the bent section in response to a measurement of a diameter of the borehole.

22. Apparatus according to claim 19 comprising a pad actuator connected to press one or more pads radially outwardly to engage a wall of the borehole wherein the controller is configured to adjust a range of oscillation of the bent section in response to a pressure on the one or more pads when pressed against the wall of the borehole.

23. Apparatus according to claim 22 wherein the controller is configured to actuate the pad actuator when the pressure on the one or more pads is within a threshold amount of a target pressure.

24. Apparatus according to claim 10 comprising a third clutch or brake wherein the controller is connected to control the third clutch or brake, the third clutch or brake operable to hold the bent section from rotating relative to a section of drill string coupled to an input shaft of the second transmission.

25. Apparatus according to claim 10 wherein the first and second transmissions provide different gear ratios.

26. Apparatus according to claim 25 wherein the gear ratio provided by the second transmission is such that the second transmission drives the bent section to counter-rotate at a speed faster than the first transmission drives the bent section to rotate.

27. Apparatus for directional drilling, the apparatus comprising:

a bent section;

a section of drill string extending from the surface uphole from the bent section;

a first reducing transmission having an input arranged to be driven by rotation of the section of drill string and an output shaft coupled to rotate an uphole end of the bent section;

a first clutch connected at an uphole end of the bent section in series with the first reducing transmission;

an orientation sensor mounted to monitor an orientation of the bent section;

a controller configured to compare the monitored orientation of the bent section to a desired orientation of the bent section and to control the first clutch to apply a correction to the orientation of the bent section;

a second reducing transmission having an output shaft coupled to a downhole end of the bent section; and a third clutch or brake wherein the controller is connected to control the third clutch or brake, the third clutch or brake operable to hold the bent section from rotating relative to a section of drill string coupled to an input shaft of the second transmission;

wherein the controller is configured to disengage the second clutch and engage the third clutch or brake when the bent section is within a threshold angle of a target direction.

28. Apparatus for directional drilling, the apparatus comprising:

a bent section;

a section of drill string extending from the surface uphole from the bent section;

a first reducing transmission having an input arranged to be driven by rotation of the section of drill string and an output shaft coupled to rotate an uphole end of the bent section by way of a first clutch connected in series with the first reducing transmission, the first reducing transmission configured to rotate the output shaft at a speed of rotation that is slower than a speed of rotation of the input;

an orientation sensor mounted to monitor a rotational orientation of the bent section;

a controller configured to compare the monitored orientation of the bent section to a desired orientation of the bent section and to control the first clutch to apply a correction to the orientation of the bent section; and an electrical generator driven by relative motion of the uphole and downhole ends of the bent section.

29. Apparatus according to claim 28 wherein the electrical generator is connected to power the controller.

30. Apparatus for directional drilling, the apparatus comprising:

a bent section having uphole and downhole ends, the uphole end of the bent section coupled by a first clutch to a section of drill string uphole from the bent section, the downhole end of the bent section coupled by way of a second clutch to a drill bit downhole from the bent section;

an orientation sensor mounted to monitor an orientation of the bent section;

a controller configured to compare the monitored orientation of the bent section to a desired orientation and to control the first and second clutches to maintain the orientation of the bent section within a desired range of the desired orientation;

wherein the bent section comprises a bent sub.

31. Apparatus according to claim 30 wherein the controller is configured to alternate between a first period of engaging the first clutch while disengaging the second clutch and a second period of engaging the second clutch while disengaging the first clutch.

32. Apparatus according to claim 31 wherein the controller is configured to set a default length for the first period by engaging the first clutch while disengaging the second clutch and monitoring a rate of rotation of the bent section.

33. Apparatus according to claim 32 wherein the controller is configured to set a default length for the second period by engaging the second clutch while disengaging the first clutch and monitoring a rate of rotation of the bent section.

34. Apparatus according to claim 33 wherein the default lengths of the first and second periods are such that there is no net change in orientation of the bent section after the first and second periods of the default lengths.

35. Apparatus according to claim 31 wherein the controller is configured to correct an average orientation of the bent section by altering the duration of one or both of the first and second periods in one or more cycles.

36. Apparatus according to claim 31 wherein the controller is configured to adjust a range of oscillation of the bent section in response to a measurement of a diameter of the borehole.

37. Apparatus according to claim 30 comprising a third clutch or brake wherein the controller is connected to control the third clutch or brake, the third clutch or brake operable to hold the bent section from rotating relative to a section of drill string downhole from the bent section.

38. Apparatus according to claim 30 wherein the controller comprises a telemetry receiver configured to receive telemetry signals comprising commands specifying the desired orientation for the bent section.

39. Apparatus according to claim 38 wherein the controller is configured to receive and store in a register a target orientation for the bent section.

40. Apparatus according to claim 35 wherein an amount by which at least one of the first and second periods is adjusted is based at least in part on a magnitude of a difference between the average orientation and the desired orientation.

41. Apparatus according to claim 35 wherein the controller is configured to adjust one or both of the first and second periods by a predetermined amount to achieve a drift in the average orientation of the bent section that tends to reduce a difference between the average orientation of the bent section and the desired orientation of the bent section.

42. Apparatus according to claim 30 comprising a first reducing transmission in series with the first clutch, the first reducing transmission having an output coupled to the bent section and an input arranged to be driven by rotation of the section of drill string uphole from the bent section.

43. Apparatus according to claim 30 comprising a second reducing transmission in series with the second clutch, the second reducing transmission having an output coupled to the bent section and an input arranged to be driven by rotation of the drill bit.

44. Apparatus according to claim 30 comprising a first reducing transmission in series with the first clutch, the first reducing transmission having an output coupled to the bent section and an input arranged to be driven by rotation of the section of drill string uphole from the bent section and a second reducing transmission in series with the second clutch, the second reducing transmission having an output coupled to the bent section and an input arranged to be driven by rotation of the drill bit wherein the first and second reducing transmissions have different gear ratios.

45. Apparatus according to claim 44 wherein the first reducing transmission has a gear ratio in the range of 20:1 to 200:1.

46. Apparatus according to claim 44 wherein the second reducing transmission has a gear ratio in the range of 50:1 to 400:1.

47. Apparatus for directional drilling, the apparatus comprising:

a bent section having uphole and downhole ends, the uphole end of the bent section coupled by a first clutch to a section of drill string uphole from the bent section, the downhole end of the bent section coupled by way of a second clutch to a drill bit downhole from the bent section;

an orientation sensor mounted to monitor an orientation of the bent section;

a controller configured to compare the monitored orientation of the bent section to a desired orientation and to control the first and second clutches to maintain the orientation of the bent section within a desired range of the desired orientation; and a third clutch or brake wherein the controller is connected to control the third clutch or brake, the third clutch or brake operable to hold the bent section from rotating relative to a section of drill string downhole from the bent section;

wherein the controller is configured to disengage the second clutch and engage the third clutch or brake when the bent section is within a threshold angle of the desired orientation.

48. A method for controlling an orientation of a section in a drill string, the method comprising:

while rotating an uphole portion of the drill string uphole from the section:

performing a first step of engaging a first clutch to couple the section to be rotated to the uphole portion of the drill string, thereby causing orientation of the section to change in a first direction; and performing a second step of disengaging the first clutch to allow the section to rotate relative to the uphole portion of the drill string while engaging a second clutch to more tightly couple the section to a rotating drill bit, thereby causing the orientation of the section to change in a second direction opposed to the first direction.

49. A method according to claim 48 comprising repeatedly performing the first and second steps in alternation.

50. A method according to claim 49 comprising altering a duration of one or both of the first and second steps and thereby altering an average orientation of the section.

51. A method according to claim 50 comprising receiving telemetry signals comprising commands specifying a desired orientation for the section and controlling the section to reduce a difference between the average orientation of the section and the desired orientation.

52. A method according to claim 48 wherein the first step comprises stepping down a rotational speed of the uphole section of the drill string to a first reduced rotational speed and driving the section at the first reduced rotational speed.

53. A method according to claim 48 wherein the second step comprises stepping down a rotational speed of a component coupling the section to the drill bit to a second reduced rotational speed and driving the section at the second reduced rotational speed.

54. A method according to claim 48 wherein the section is a bent section.

55. A method for controlling the orientation of a bent section of a directional drilling string, the method comprising:

detecting a current orientation of the bent section;

comparing the current orientation to a desired orientation;

engaging a first clutch coupled between the bent section and a rotating section of the drill string uphole from the bent section and disengaging a second clutch coupled between the bent section and a rotating section of the drill string downhole from the bent section to rotate the bent section if the orientation of the bent section is more than a first threshold amount away from the desired orientation in a first direction;

engaging the second clutch and disengaging the first clutch to counter-rotate the bent section if the orientation of the bent section is more than a second threshold amount away from the desired orientation in a second direction opposite to the first direction;

wherein the bent section comprises a bent sub.

56. A method according to claim 55 wherein the first and second thresholds are 1½ degrees or less.

57. A method according to claim 55 comprising increasing a range of oscillation of the bent section to compensate for wear of a drill bit in the drill string.

58. A method according to claim 55 wherein a first reducing transmission is coupled to the first clutch, a second reducing transmission is coupled to the second clutch, and the gear ratio of the first and second transmissions is selected such that the bent section counter-rotates at a speed faster than it is driven to rotate.

59. A method for controlling the orientation of a bent section of a directional drilling string comprising:

detecting a current orientation of the bent section;

comparing the current orientation to a desired orientation;

engaging a first clutch coupled between the bent section and a rotating section of the drill string extending to the surface uphole from the bent section to rotate the bent section if the orientation of the bent section is more than a first threshold amount away from the desired orientation in a first direction;

disengaging the first clutch if the orientation of the bent section is more than a second threshold away from the desired orientation in a second direction;

wherein the first clutch is coupled to the section of the drill string uphole from the bent section by a first reducing transmission having an input connected to be driven by the rotating section of the drill string and an output connected to drive rotation of the bent section and the method comprises, when the first clutch is engaged, operating the first transmission to drive the bent section at a rotational speed that is reduced relative to a rotational speed of the rotating section of the drill string;

wherein the bent section comprises a bent sub;

wherein a first anti-rotation apparatus is attached to a body of the first reducing transmission.

* * * * *